US008495891B2

(12) United States Patent
Kim et al.

(10) Patent No.: US 8,495,891 B2
(45) Date of Patent: Jul. 30, 2013

(54) REFRIGERATOR RELATED TECHNOLOGY

(75) Inventors: Dong-Jeong Kim, Seoul (KR); Bong-Jin Kim, Seoul (KR); Chang-Ho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 945 days.

(21) Appl. No.: 12/607,112

(22) Filed: Oct. 28, 2009

(65) Prior Publication Data

US 2010/0122548 A1 May 20, 2010

(30) Foreign Application Priority Data

Nov. 19, 2008 (KR) ..... 10-2008-0115388

(51) Int. Cl.
*F25C 5/18* (2006.01)

(52) U.S. Cl.
USPC ..... 62/344; 62/440; 62/449

(58) Field of Classification Search
USPC ..... 62/344, 340, 349, 377, 440, 441, 62/449
See application file for complete search history.

(56) References Cited

U.S. PATENT DOCUMENTS

| | | | | |
|---|---|---|---|---|
| 6,945,068 | B2 | 9/2005 | Kim | |
| 7,004,334 | B2 | 2/2006 | Walsh | |
| 7,076,967 | B2 | 7/2006 | Lee | |
| 7,111,914 | B2 | 9/2006 | Avendano | |
| 7,222,498 | B2 | 5/2007 | Lee | |
| 7,240,510 | B2 | 7/2007 | Lee | |
| 7,240,511 | B2 * | 7/2007 | Lee et al. | 62/353 |
| 7,272,949 | B2 | 9/2007 | Lee | |
| 7,392,665 | B2 | 7/2008 | Lee | |
| 7,458,230 | B2 | 12/2008 | Lee | |
| 7,493,777 | B2 | 2/2009 | Kim | |
| 2006/0096310 | A1 | 5/2006 | Lee | |
| 2006/0196214 | A1 | 9/2006 | Lee | |
| 2008/0209938 | A1 | 9/2008 | Lee | |

FOREIGN PATENT DOCUMENTS

| | | | |
|---|---|---|---|
| CN | 101074822 | A | 11/2007 |
| CN | 201043839 | Y | 4/2008 |
| KR | 2001044379 | A | 6/1999 |
| KR | 2001047668 | A | 6/2001 |
| KR | 2008016032 | A | 2/2008 |
| KR | 2008020126 | A | 3/2008 |

OTHER PUBLICATIONS

International Search Report issued in Application No. PCT/KR2009/006815, mailed May 24, 2010, 11 pages.
Chinese Office Action dated Oct. 10, 2012 for Application No. 200980144104.7 with English Translation, 15 pages.

* cited by examiner

*Primary Examiner* — Melvin Jones
(74) *Attorney, Agent, or Firm* — Fish & Richardson P.C.

(57) ABSTRACT

Disclosed is a refrigerator including a refrigerator main body having a cooling chamber. The refrigerator also includes a refrigerating chamber door positioned at the refrigerator main body and configured to open and close at least a portion of a refrigerating chamber. The refrigerator further includes an ice chamber disposed at an inner surface of the refrigerating chamber door containing ice. In addition, the refrigerator includes a door basket configured to be attached to an outer surface of the ice chamber and having a non-contact portion positioned at a surface facing the ice chamber.

18 Claims, 6 Drawing Sheets

REFRIGERATOR RELATED TECHNOLOGY

CROSS-REFERENCE TO RELATED APPLICATIONS

The present application claims the benefit of priority to Korean Application No. 10-2008-0115388, filed on Nov. 19, 2008, the contents of which is incorporated by reference herein in its entirety.

FIELD

The present disclosure relates to refrigerator technology.

BACKGROUND

In general, a refrigerator is a device for keeping foods or the like in predefined accommodation spaces at a low temperature. The refrigerator may have a refrigerating chamber maintained at a temperature above zero and a freezing chamber maintained at a temperature below zero by discriminating low temperature environments.

As the demand of ice increases, an automatic ice making apparatus mounted in a refrigerator was disclosed.

The automatic ice making apparatus (hereinafter, referred to as 'ice making apparatus') may be installed either in a freezing chamber or in a refrigerating chamber according to a type of a refrigerator. In case of the ice making apparatus being installed in the refrigerating chamber, cool air within the freezing chamber is provided to the ice making apparatus so as to make ice.

Also, in case of installing the ice making apparatus at a refrigerating chamber, the ice making apparatus may have an ice maker for actually making ice, and an ice bank for storing the ice made by the ice maker. The ice maker may be disposed in the refrigerating chamber and the ice bank may be disposed in the ice making chamber of the refrigerating chamber door, or both the ice maker and the ice bank may be disposed in the ice making chamber of the refrigerating chamber door.

If the ice making apparatus is installed at the refrigerating chamber, frost may occur on a surface of the ice making chamber due to a temperature difference between a temperature of the refrigerating chamber and a temperature of the ice making chamber. Also, in case of disposing a basket at an outer surface of the ice making chamber, frost may occur due to a temperature difference between an inner surface of the basket and an outer surface of the ice making chamber, and such frost may grow to interfere with a cool air circulation of the refrigerating chamber. For instance, the ice making chamber is disposed at the refrigerating chamber door, the refrigerating chamber is divided into plural layers (spaces, partitions) by a plurality of shelves, and a plurality of door baskets are disposed at the outer surface of the ice making chamber, for example, each door basket is disposed at interval of each partition of the refrigerating chamber, frost may occur on an inner surface of the door basket because the temperature inside of the door basket is higher than a temperature of the ice making chamber. Accordingly, frost may interfere with the circulation of cool air into each partition, causing the lowering of the performance of the refrigerator.

Further, in case that a cool air passes through a hole in the door basket, frost, which occurs on the inner surface of the door basket, gradually grows, thereby, the hole may be blocked.

SUMMARY

In one aspect, a refrigerator includes a refrigerator main body having a cooling chamber. The refrigerator also includes a refrigerating chamber door positioned at the refrigerator main body and configured to open and close at least a portion of a refrigerating chamber. The refrigerator further includes an ice chamber disposed at an inner surface of the refrigerating chamber door. In addition, the refrigerator includes a door basket configured to be attached to an outer surface of the ice chamber having a non-contact portion positioned at a surface facing the ice chamber when the door basket is attached to the outer surface of the ice chamber.

Implementations may be include one or more of the following features. For example, the non-contact portion of the door basket has a cut off portion. The door basket may further includes one or more reinforcing ribs. The non-contact portion of the door basket has a curved shape. In some examples, the non-contact portion of the door basket have an area corresponding to over 50% of an area of a surface of the door basket facing the ice chamber. At least one cool air through hole defined in a surface of the door basket and is configured to enable passage of cool air through the surface of the door basket.

In another aspect, a refrigerator includes a refrigerator main body having a cooling chamber. The refrigerator also includes a refrigerator door positioned at the refrigerator main body. The refrigerator further includes an ice compartment configured to store ice and positioned in the refrigerator door. The refrigerator further includes a door basket positioned at an inside of the refrigerating door and configured to store food or other items. In addition, the refrigerator includes a connector configured to connect the refrigerator door and the door basket and reduce contact between the refrigerator door and the door basket. Implementations may be include one or more of the following features. For example, the ice container may include an ice making apparatus. The ice making apparatus may further includes an ice maker configured to make ice and an ice bank configured to store the ice made by the ice maker.

In some examples, the ice container may include the ice bank. One side of an accommodation portion of the door basket that is close to the refrigerator door may have a non-contact portion to reduce contact between the refrigerator door and the door basket. The non-contact portion of the door basket may be cut off.

The non-contact portion of the door basket may be curved. The non-contact portion of the door basket may have an area corresponding to over 50% of an area of a surface of the door basket facing the ice compartment. At least one cool air through hole defined in a surface of the door basket and is configured to enable passage of cool air through the surface of the door basket.

The connector may include a reinforced portion where the door basket connects to the refrigerator door. The connector may be configured to connect both sides of the door basket to the refrigerator door.

In yet another aspect, a refrigerator includes a refrigerator main body having a cooling chamber. The refrigerator also includes a refrigerator door positioned at the refrigerator main body. The refrigerator further includes an ice compartment configured to store ice and positioned in the refrigerator door. The refrigerator further includes a door basket positioned at an inside of the refrigerating door and configured to store food or other items. In addition, the refrigerator includes a connector configured to connect the refrigerator door and the door basket and has a non-contacting portion wherein an area of the non-contacting portion between the refrigerator door and the door basket is larger than an area of a contacting portion between the refrigerator door and the door basket.

Implementations may be include one or more of the following features. For example, the non-contact portion of the door basket is cut off. At least one cool air through hole is defined in a surface of the door basket and is configured to enable passage of cool air through the surface of the door basket.

DETAILED DESCRIPTION

Figure 1:
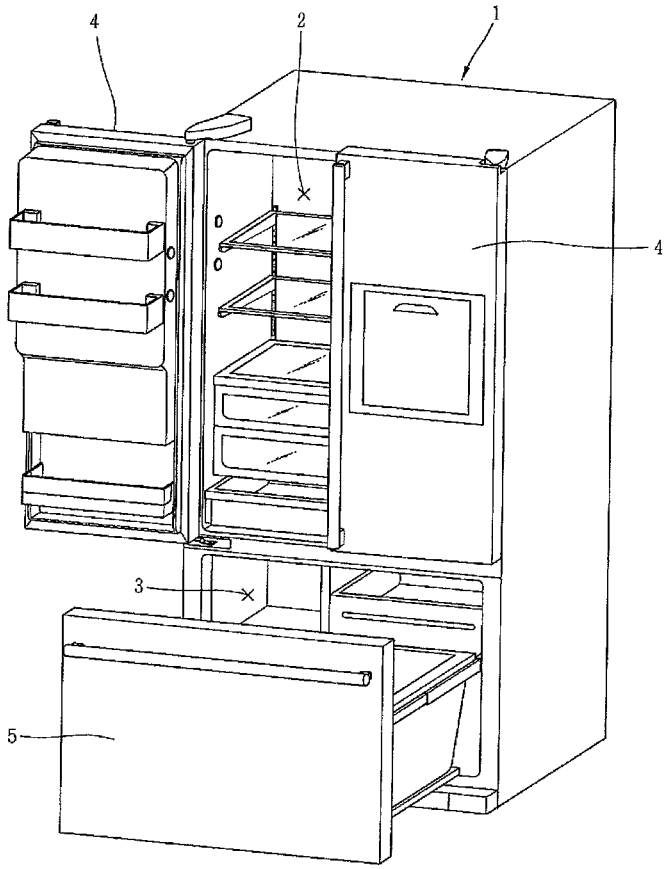
FIG. 1 is a perspective view showing a bottom freezer type refrigerator having a door basket.

As shown in FIG. 1, a refrigerator may include a refrigerating chamber 2 disposed at an upper side of a refrigerator main body 1 for storing foods in a fresh state, and a freezing chamber 3 disposed at a lower side of the refrigerator main body 1 for storing foods in a frozen state. A plurality of refrigerating chamber doors 4 for opening and closing the refrigerating chamber 2 may be installed at both sides of the refrigerating chamber 2, and the freezing chamber 3 has one freezing chamber door 5 for opening and closing the freezing chamber 3. A machine chamber that includes a compressor and a condenser may be positioned at a lower end portion of a rear surface of the refrigerator main body 1. An evaporator for a refrigerator connected to the condenser and the compressor for supplying cool air into the refrigerating chamber 2 and the freezing chamber 3 may be disposed at a rear surface, side surface or upper surface of the refrigerator main body 1, or within a barrier dividing an inside of the refrigerator main body 1 into the refrigerating chamber 2 and the freezing chamber 3. The evaporator for the refrigerator may be implemented as a single evaporator so as to distributively supply cool air into the refrigerating chamber 2 and the freezing chamber 3. Alternatively, an evaporator for a refrigerating chamber and an evaporator for a freezing chamber may be individually implemented to supply cool air respectively into the refrigerating chamber 2 and the freezing chamber 3.

Figure 2:
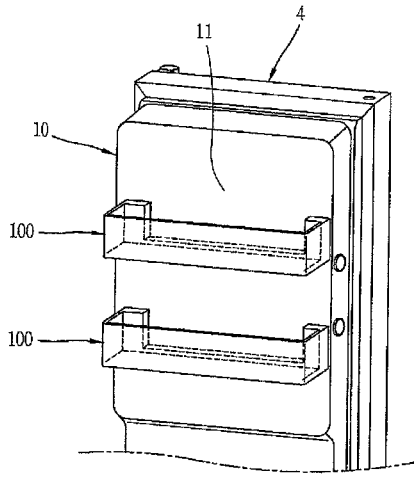
FIG. 2 is a perspective view showing a refrigerating chamber having the door basket of FIG. 1.
Figure 3:
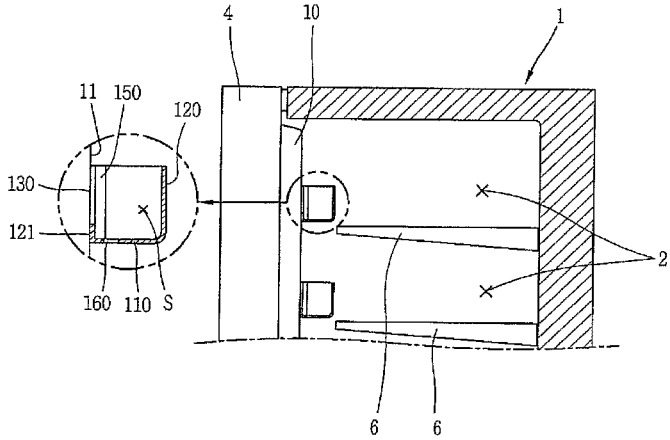
FIG. 3 is a longitudinal sectional view showing the refrigerating chamber having the door basket of FIG. 1.

As shown in FIGS. 2 and 3, an ice making chamber 10 in which ice cubes are made and then stored may be positioned at an inner wall surface of one of the refrigerating chamber doors 4. An ice making apparatus for making ice cubes may be installed in the ice making chamber 10. An ice bank for storing ice cubes made by the ice making apparatus may be disposed below the ice making apparatus. The ice making apparatus may be disposed at the refrigerating chamber 2 and the ice bank may be disposed at the refrigerator chamber door 4, according to the type of refrigerator. As shown in FIGS. 2 and 3, a door basket 100 or a plurality of baskets for storing foods may be installed at an outer surface of the ice making chamber 10, namely, at an outer surface of an ice making chamber cover 11 for covering the ice making chamber 10.

Figure 4:
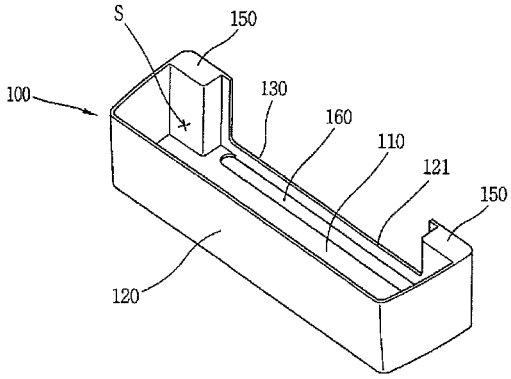
FIGS. 4 and 5 are a perspective view and a plane view, respectively, showing the door basket of FIG. 1.
Figure 5:
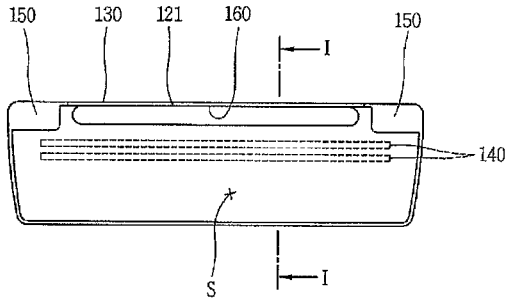

As shown in FIGS. 4 and 5, the door basket 100 may include a bottom portion 110 defined in a square shape, and an accommodation portion 120 protruded from an edge of the bottom portion 110 to have a predetermined height. The accommodation portion 120 may entirely be protruded upwardly along the edge of the bottom portion 110. One side of the accommodation portion 120 has a non-contact portion 130. The non-contact portion 130 may be configured to minimize the contact between the accommodation portion 120 and a wall surface of the ice making chamber 10, such as an outer surface of an ice making chamber cover 11.

The non-contact portion 130 may be configured such that the door basket 100 is not contactable with the outer surface of the ice making chamber 10. In some cases, the non-contact portion 130 may be configured such that a part of the door basket 100 is not contactable with the outer surface of the ice making chamber 10 to reduce an area where frost occurs. For example, if the non-contact portion 130 is configured to have an area that is just below 50% of an entire area of a fixed surface 121 of the door basket 110 facing the ice making chamber 10, frost can be reduced to some extent. In some examples, in order to effectively reduce the occurrence of frost and effectively decrease flow resistance of cool air due to the frost, the non-contact portion 130 may be configured to have an area more than approximately 50% of the area of the fixed surface 121.

The non-contact portion 130 may be defined to be open (removed) as if the fixed surface 121, such as the surface facing the outer surface of the ice making chamber 10, is cut off. For example, when molding the door basket 100, the mold is fabricated to have the non-contact portion 130 such that part of the is accommodation portion 120 of the door basket 100 can be open (removed), thus to have the open non-contact portion 130.

As such, if the non-contact portion 130 exists at the door basket 100, for example, at the fixed surface 121 for fixing the door basket 100 to the ice making chamber cover 11, the intensity of the door basket 100 may be weakened. Accordingly, the door basket 100 may be apt to be damaged due to weakened standing for the weight of items (e.g., foods) stored therein. Considering such probability, the door basket 100 may have at least one or more reinforcing ribs 140 for reinforcing the structural integrity of the door basket 100, as shown in FIGS. 6 and 7.

The reinforcing rib 140 may be positioned at any of an inner surface or an outer surface of the door basket 100 if it has preset thickness and length. In addition, if the reinforcing rib 140 is positioned at the outer surface of the door basket 100, it can prevent the decrease of an accommodation space S of the door basket 100. The reinforcing rib 140 also may be positioned at a lower surface of the bottom portion 110 of the door basket 100, thus to reinforce the structural integrity of the door basket 100 as compared to being positioned at a side surface of the door basket 100. Further, by positioning the reinforcing rib 140 at the lower surface of the door basket 100, it is not needed to enlarge the to refrigerating chamber door 4 for ensuring an installation space of the door basket 100.

The reinforcing rib 140 may be horizontally located in a lengthwise direction or be located back and forth in a widthwise direction. If the cool air through hole 160 is horizontally positioned long in the lengthwise direction, the reinforcing rib 140 may also be positioned long in the horizontal lengthwise direction in association with the shape of the cool air through hole 160.

Figure 6:
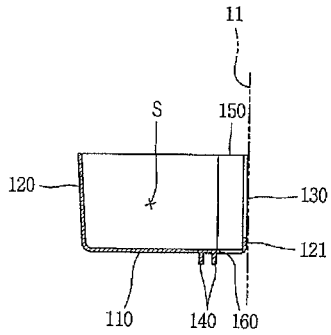
FIGS. 6 and 7 are cross-sectional views showing implementations taken along the line of FIG. 5.
Figure 7:
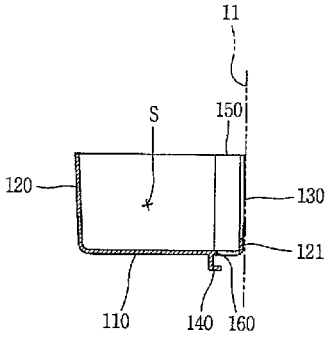

The reinforcing rib 140, as shown in FIG. 6, may be implemented as a hexahedral shape. Alternatively, in order to have a sufficient reinforcement length and ensure a sufficient accommodation space C of a lower door basket 100, the reinforcing rib 140 may be implemented as curved at its middle portion, as shown in FIG. 7. Further, the reinforcing rib 140 may be implemented as various shapes, for example, a combination of one in a simply rectangular parallelepiped shape and another in a curved shape.

Referring to FIGS. 4 and 5, reinforcing portions 150 having a thickness thicker than the bottom portion 110 or the accommodation portion 120 of the door basket 100 may be positioned at a rear surface of the door basket 100, such as at both sides of a surface with the non-contact portion 130. The reinforcing portion 150, as shown in FIGS. 4 and 5, may be implemented as a shape of filled pillar. Alternatively, the reinforcing portion 150 may be implemented as a hollow pillar.

In the meantime, one or more cool air through holes 160 which allow cool air to flow into each partition, may positioned at the bottom portion 110 of the door basket 100. The cool air through hole 160 may be implemented as various shapes by considering how much cool air is circulated.

For example, the cool air through holes 160 may be positioned at a rear side, for example, close to the ice making chamber 10, or be positioned at the entire bottom surface with a uniform interval. Further, the cool air through hole 160 may be defined as one hole long in a widthwise direction, or may be defined as a plurality of holes divided in a widthwise direction.

The operation of the refrigerator will be described hereinafter. Upon an ice making operation being requested, the ice making apparatus in the ice making chamber 10 is turned on and the ice making operation is started. Upon the ice making operation being started, a water supply unit (not shown) supplies water into an ice making tray of the ice making apparatus. After the water is completely supplied, the water within the ice making tray is exposed to cool air supplied via a cool air duct for a predetermined time to thereby be frozen.

Here, as the ice making chamber 10 is installed at the refrigerating chamber door 4, a temperature difference occurs between the ice making chamber 10 and the refrigerating chamber 2. Such temperature difference may cause frost to occur on an inner surface of the door basket 100 that is in contact with the ice making chamber 10. However, because the door basket 100 has the non-contact portion 130, the occurrence of frost in the door basket 100 can be reduced or prevented. In addition, the reduction of strength of the door basket 100, which may be caused by having the non-contact portion 130 shown in FIG. 4, can be relieved by the reinforcing ribs 140 and the reinforcing portions 150, thereby allowing foods to be stably stored in the door basket 100.

The plurality of cool air through holes 160 may be positioned at the bottom surface of the door basket 100 such that cool air can smoothly flow into each partition (layer, space). Accordingly, a temperature deviation between the partitions (layers) can be reduced or prevented in advance, thus to enable foods stored in each partition to be maintained in a fresh state.

Figure 8:
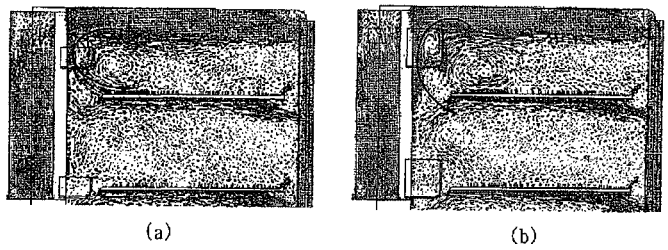
FIG. 8 is a view showing the comparison of a cool air circulation depending on a position of a cool air through hole at the door basket of FIG. 1, FIG. 8(*a*) shows that the cool air through hole is positioned at a front side and FIG. 8(*b*) shows that the cool air through hole is positioned at a rear side.

Here, if the cool air through hole 160 is positioned farther away from the accommodation shelf 6 (see FIGS. 2 and 3) of the refrigerating chamber 2, such as near the ice making chamber 10, cool air can flow more smoothly. Referring to FIG. 8, it shows a cool air circulation that cool air flows from an upper partition down to a lower partition of the refrigerating chamber 2 in case where the cool air through hole 160 is positioned at the rear side of the bottom portion 110, such as close to the ice making chamber 10. It can be noticed that as the cool air through hole 160 is positioned close to the ice making chamber 10 as shown in FIG. 8(*a*), the flow resistance is decreased so as to result in a smooth flow of cool air, as compared to being positioned relatively away from the ice making chamber 10 as shown in FIG. 8(*b*).

Figure 9:
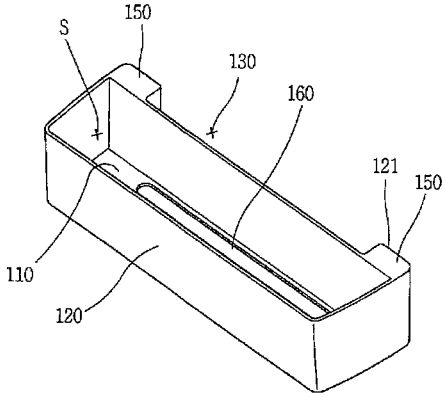
FIGS. 9 and 10 are a perspective view and a plane view, respectively, showing another implementation of the door basket of FIG. 1.
Figure 10:
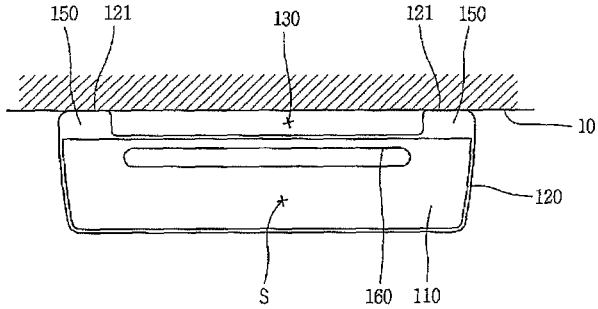

Hereinafter, another implementation of the refrigerator having a non-contact portion of the door basket will be described. As shown in FIGS. 9 and 10, the door basket 100 may be configured such that part of the fixed surface 121 is curved farther away from the ice making chamber 10 to be concave by a preset depth and thus an outer surface of the ice making chamber 10 is not contactable with the door basket 100. Hence, even if a temperature difference occurs between the ice making chamber 10 and the refrigerating chamber 2, the occurrence of frost on the inner surface of the door basket 100 can be reduced or prevented.

Here, the non-contact portion 130 may be positioned between the reinforcing portions 150 located at both sides of the basket 100 to maintain the structural integrity of the door basket 100. Also, the non-contact portion 130 may define linearly along a lengthwise direction of the reinforcing portions 150, which can facilitate manufacturing the basket as shown FIG. 9 having the non-contact portion 130.

The non-contact portion 130 may be configured to have an interval as wide as allowing cool air to smoothly flow there through and not excessively occupying the accommodation space S, e.g., as wide as a diameter of the reinforcing portion 150.

In this implementation, the door basket may have the same basic configuration to that of the door basket in the previous implementation, such as the same configurations for the reinforcing ribs, the reinforcing portions and the cool air through hole, so the effect of the operation may be similar to each other. However, in this implementation, because the non-contact portion 130 may be defined by being curved toward the inside of the accommodation space S, it maintains the strength of the door basket 100. Hence, the strength of the door basket 100 can be maintained even without the reinforcing ribs at the door basket 100. In this implementation, the process of manufacturing the basket my be simplified because manufacturing the reinforcing ribs 140 is not needed. Further, if the reinforcing ribs 140 are not needed, the lower part of the door basket 100 can extend an accommodation space S. Accordingly, the door basket 100 can accommodate (store) more items (e.g., foods) in the accommodation space S or have a reduced size for the same accommodation capacity. Further, if the reinforcing ribs 140 are not positioned at the door basket 100, the flow resistance of cool air can be reduced.

In the configuration of the refrigerator having the door basket, the non-contact portion which is not contactable with the ice making chamber, may be to positioned at one side surface of the door basket, which is close to an outer surface of the ice making chamber, and accordingly the occurrence of frost in the door basket can be reduced. Further, the reduction of structural integrity of the door basket, which is caused by including the non-contact portion at the door basket, can be reduced or overcome by having the reinforcing ribs or reinforcing portions. Further, the cool air through holes positioned at the door basket may be close to the ice making chamber or uniformly arranged, so that this can distribute cool air to each partition equally.

The implementations may be applicable to a refrigerator having the ice making chamber at a refrigerating chamber door or a refrigerator having the ice making chamber at a refrigerating chamber.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a refrigerator main body having a cooling chamber;

a refrigerating chamber door positioned at the refrigerator main body and configured to open and close at least a portion of a refrigerating chamber;

an ice chamber disposed at an inner surface of the refrigerating chamber door; and a door basket configured to be attached to an outer surface of the ice chamber and having a non-contact portion positioned at a surface facing the ice chamber when the door basket is attached to the outer surface of the ice chamber, wherein the door basket has at least one cool air through hole that is defined in a surface of the door basket and that is configured to enable passage of cool air through the surface of the door basket.

2. The refrigerator of claim 1, wherein the non-contact portion of the door basket is has a cut off portion.

3. The refrigerator of claim 1, wherein the door basket further comprising:

one or more reinforcing ribs coupled to the outer surface of the ice chamber.

4. The refrigerator of claim 1, wherein the non-contact portion of the door basket is has a curved shape.

5. The refrigerator of claim 1, wherein the non-contact portion of the door basket has an area corresponding to over 50% of an area of a surface of the door basket facing the ice chamber.

6. A refrigerator comprising:

a refrigerator main body having a cooling chamber;

a refrigerator door positioned at the refrigerator main body;

an ice compartment configured to store ice and positioned in the refrigerator door;

a door basket positioned at an inside of the refrigerating door configured to store food or other items; and a connector configured to connect the refrigerator door and the door basket and reduce contact between the refrigerator door and the door basket, wherein the connector includes a reinforced portion where the door basket connects to the refrigerator door.

7. The refrigerator of claim 6, further comprising:

an ice making apparatus positioned in the ice compartment.

8. The refrigerator of claim 7, the ice making apparatus further comprising:

an ice maker configured to make ice; and an ice bank configured to store the ice made by the ice maker.

9. The refrigerator of claim 6, further comprising:

an ice storage positioned in the ice compartment.

10. The refrigerator of claim 6, wherein one side of an accommodation portion of the door basket that is close to the refrigerator door has non-contact portion to reduce contact between the refrigerator door and the door basket.

11. The refrigerator of claim 10, wherein the non-contact portion of the door basket is cut off.

12. The refrigerator of claim 10, wherein the non-contact portion of the door basket is curved.

13. The refrigerator of claim 10, wherein the non-contact portion of the door basket has an area corresponding to over 50% of an area of a surface of the door basket facing the ice compartment.

14. The refrigerator of claim 6, wherein at least one cool air through hole is defined in a surface of the door basket and is configured to enable passage of cool air through the surface of the door basket.

15. The refrigerator of claim 6, wherein the connector is configured to connect both sides of the door basket to the refrigerator door.

16. A refrigerator comprising:

a refrigerator main body having a cooling chamber;

a refrigerator door positioned at the refrigerator main body;

an ice compartment configured to store ice and positioned in the refrigerator door;

a door basket positioned at an inside of the refrigerating door configured to store food or other items; and a connector configured to connect the refrigerator door and the door basket and that has a non-contacting portion between the refrigerator door and the basket, wherein an area of the non-contacting portion between the refrigerator door and the door basket is larger than an area of a contacting portion between the refrigerator door and the door basket.

17. The refrigerator of claim 16, wherein the non-contact portion of the door basket is cut off.

18. The refrigerator of claim 16, wherein at least one cool air through hole is defined in a surface of the door basket and is configured to enable passage of cool air through the surface of the door basket.

* * * * *